US009587406B2

(12) United States Patent
Bangratz

(10) Patent No.: US 9,587,406 B2
(45) Date of Patent: Mar. 7, 2017

(54) PANEL RAILING

(76) Inventor: René Bangratz, Heilbronn (DE)

( * ) Notice: Subject to any disclaimer, the term of this patent is extended or adjusted under 35 U.S.C. 154(b) by 802 days.

(21) Appl. No.: 13/991,367

(22) PCT Filed: Dec. 1, 2011

(86) PCT No.: PCT/DE2011/002065
§ 371 (c)(1),
(2), (4) Date: Jun. 3, 2013

(87) PCT Pub. No.: WO2012/075997
PCT Pub. Date: Jun. 14, 2012

(65) Prior Publication Data

US 2013/0240814 A1 Sep. 19, 2013

(30) Foreign Application Priority Data

Dec. 6, 2010 (DE) ..... 20 2010 016 188 U

(51) Int. Cl.
*E04F 11/18* (2006.01)

(52) U.S. Cl.
CPC ..... *E04F 11/1817* (2013.01); *E04F 11/1851* (2013.01)

(58) Field of Classification Search
CPC ..... E04F 11/18; E04F 11/181; E04F 11/1853; E04F 2011/1823; E04F 2011/1825; E04F 2011/1829; E04F 2011/1831
See application file for complete search history.

(56) References Cited

U.S. PATENT DOCUMENTS 4,690,383 A * 9/1987 Batcheller ..... E04F 11/181 256/24
5,339,583 A * 8/1994 Hrdlicka ..... E06B 3/302 156/293
6,517,056 B2 * 2/2003 Shepherd ..... E04F 11/1851 256/24

FOREIGN PATENT DOCUMENTS

DE 38 28 632 A1 3/1990
DE 20 2007 009 239 * 9/2007 ..... E04F 11/18
DE 20 2007 009 239 U1 10/2007
DE 20 2009 004773 U1 7/2009
FR 2 235 612 A5 1/1975
WO WO-2009/003452 A1 1/2009
WO WO-2009/123443 A1 10/2009

OTHER PUBLICATIONS

International Search Report mailed Mar. 30, 2012 for the corresponding PCT Application No. PCT/DE2011/002065.

(Continued)

*Primary Examiner* — Michael P Ferguson
(74) *Attorney, Agent, or Firm* — Leason Ellis LLP

(57) ABSTRACT

A panel railing has a dimensionally stable U-shaped profile. Between the two limbs of the U-shaped profile, the base region of a glass pane is held in a clamped manner. A spacer body and a rod body are arranged in the opening region of the U-shaped profile between the glass pane and one limb. The rod body is provided in an upper, free edge region of at least one of the two limbs. The rod body is placed in a pressing manner with its one outer face against the limb and with its other outer face, which lies opposite the former, against the glass pane. On the inner side of the limb, there is at least one projection which protrudes from said limb in the direction of the glass pane and is present below the maximum width extent of the rod body.

9 Claims, 1 Drawing Sheet

(56) References Cited

OTHER PUBLICATIONS

International Preliminary Examination Report mailed Jun. 6, 2013 for the corresponding PCT Application No. PCT/DE2011/002065.

* cited by examiner

PANEL RAILING

CROSS-REFERENCE TO RELATED PATENT APPLICATIONS

This application is a U.S. National Phase Application under 35 U.S.C. §371 of International Patent Application No. PCT/DE2011/002065, filed Dec. 1, 2011, and claims the benefit of German Patent Application No. 20 2010 016 188.6, filed Dec. 6, 2010, all of which are incorporated by reference herein in their entity. The International Application was published in German on Jun. 14, 2012 as International Publication No. WO/2012/075997 under PCT Article 21(2).

FIELD OF THE INVENTION

The invention relates to a panel railing, by means of which panels are held in a clamped manner in their base region, with the result that railing posts can be dispensed with.

BACKGROUND OF THE INVENTION

Corresponding glass-pane railings are known, for example, from DE 20 2007 009 239 U1 or WO 2009/003452 A1. In railings of this type, it is provided to insert the glass panel, which can also consist, for example, of two individual panes which are connected to one another, such as, in particular, adhesively bonded to one another, into a U-shaped profile which holds the glass pane in a clamped manner. The inner walls of said U-shaped profile are of planar configuration. The base region of the glass pane is enclosed by way of a U-shaped profile body made from plastic which is inserted into the U-shaped profile before the mounting of the glass pane. An exact and tilt-resistant alignment of the glass pane takes place subsequently by means of wedge-like inserts. Here, the U-shaped profile body which encloses the base region of the glass pane reaches on both sides of the glass pane as far as into the opening region of the U-shaped profile. Before the glass pane is inserted into the U-shaped profile, said U-shaped profile has already been screwed or welded to a fastening profile which is arranged fixedly on a building. To this end, one of the two limbs of the U-shaped profile can have a bent-over portion, by means of which the U-shaped profile can be hooked onto the fastening profile.

SUMMARY OF THE INVENTION

Proceeding from this previously known prior art, the invention is based on the object of specifying an improved panel railing which can be produced in an economically favorable manner and makes mounting possible which is as simple and rapid as possible.

The panel railing according to the invention is produced by the features of the main claim. Appropriate developments of the invention are the subject matter of further claims which follow the main claim.

It is provided according to the invention to use a rod body as spacer body in the upper, free edge region of at least one of the two limbs of the U-shaped profile. Said rod body bears in a pressing manner with its one outer face against the limb of the U-shaped profile, whereas it bears in a pressing manner with its other outer face which lies opposite the former against the panel. A projection which is directed away from the limb and protrudes in the direction of the panel is situated on the inner side of the limb, against which inner side the rod body is placed in a pressing manner. Said projection is present below the maximum width extent of the rod body, with the result that the rod body can be inserted to a certain extent into the U-shaped profile. At the same time, said projection prevents the rod body from sliding down too far, since the rod body rests on the projection of the limb in its state in which it is seated to the maximum extent in the U-shaped profile.

The inner side of the limb, against which inner side the rod body can be placed in a pressing manner, can have a plurality of projections which are arranged at a mutual spacing from one another. In particular, said inner side can be of wedge-like configuration, with the result that a lower projection protrudes further than an upper projection into the interior of the U-shaped profile in the direction transversely with respect to the panel plane. In this way, a rod body can be placed with different depths in the interior of the U-shaped profile, as a result of which an orientation of the panel in the U-shaped profile becomes possible. It would also be possible to place in each case rod bodies with a different maximum width extent on the different projections; the rod body with the smallest maximum width extent should be arranged at the very bottom.

In order to make mounting of the panel possible which is as uniform as possible, each rod body can have identical maximum width cross sections along its rod axis. A rod body of this type should be inserted into the U-shaped profile with its longitudinal axis approximately parallel to the longitudinal axis of said U-shaped profile. In particular, each rod body can have identical cross sections along its rod axis. In one particularly preferred embodiment, the rod body can be configured as a round rod or oval rod. It would also be possible to provide the rod body in a droplet shape or with a polygonal cross section, for example a hexagonal cross section.

A rod body of this type can be present on both sides of the panel. In one preferred embodiment, the panel can be held on its one side by a rod body and on its other side by a spacer body such that it is pressed in between the two limbs of the U-shaped profile. In this way, the mounting can take place in a particularly simple manner by virtue of the fact that first of all the spacer body is positioned between the one limb of the U-shaped profile and the panel. Subsequently, the rod body can be placed in the opening region between the other limb and the panel. If the panel is now pressed somewhat against the spacer body, the rod body can automatically slide or fall downward into the U-shaped profile until the panel is held in a clamped manner. As a result of the projections which are present on the inner side of the limb of the U-shaped profile, the rod body can slide into the U-shaped profile only as far as a predetermined point, with the result that excessively deep seating or falling down of the rod body can be prevented.

The spacer body can be clipped into a groove on the inner side of the limb of the U-shaped profile. In this case, the spacer body could have a corresponding tongue which can be inserted or pushed into the groove of the U-shaped profile, in order to fasten the spacer body to the limb of the U-shaped profile in a positionally secure manner. Here, the groove of the U-shaped profile does not have to be filled completely by the tongue of the spacer body, but rather it can be sufficient to configure the tongue to be somewhat shorter than the groove. As an alternative or in addition to this, the tongue could be of somewhat wider configuration than the groove at least in some regions, with the result that the tongue would have to be compressed, in order for it to be possible to insert it into the groove. In order to facilitate compression of this type of the tongue, the tongue could have an approximately horizontal slot, as a result of which the tongue would spread open slightly within the groove.

As an alternative or in addition to this, the spacer body can be supported in terms of load on a profile body which is present in the base region of the U-shaped profile. This can be realized, for example, by virtue of the fact that the profile body is present in an integral form with the spacer body. The spacer body could also be present in a separate form from the profile body and could reach into the U-shaped profile to such a depth that it rests on one of the walls of the profile body.

The upper opening region of the U-shaped profile can be covered laterally of the panel on both sides in each case by a covering profile. Said covering profile can prevent the ingress of moisture, for example as a result of rain, and can ensure a visually pleasing termination of the U-shaped profile. In one particularly preferred embodiment, the covering profile can be connected integrally to the spacer body. The covering profile and spacer body can therefore be mounted in a single work step; subsequent post-treatment of the upper opening region of the U-shaped profile is therefore not required.

The covering profile can have a longitudinal groove which can be clamped into a rib-like projection of the limb of the U-shaped profile. An embodiment of this type can also be used in an integrated configuration of covering profile and spacer body.

Both rod bodies and spacer bodies do not have to be present over the entire length of the U-shaped profile. Rather, it can be sufficient to provide spacer bodies and rod bodies merely in sections. It would also be possible, for example, to configure the spacer body as a continuous spacer element, whereas the rod body is present only at certain intervals.

Further advantages and features of the invention can be gathered from the features which are specified further in the claims and from the following exemplary embodiment.

BRIEF DESCRIPTION OF THE DRAWING

In the following text, the invention will be described and explained in greater detail using the exemplary embodiment which is shown in the drawing, in which.

DETAILED DESCRIPTION OF THE INVENTION

Figure 1:
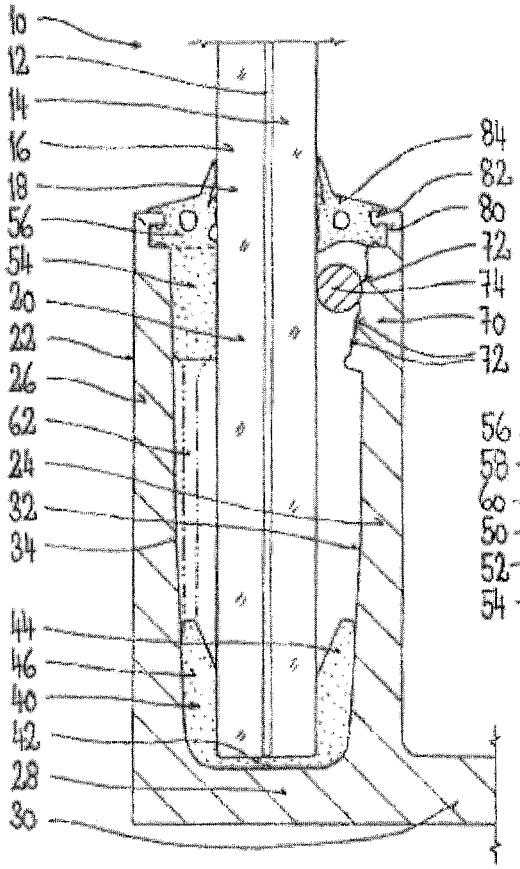
FIG. 1 shows a cross section through the base region of a glass-pane railing according to the invention.

FIG. 1 shows details of a glass-pane railing 10 with its base region in cross section. The glass pane 18 which consists in the present exemplary case of two panels 14, 16 which are adhesively bonded fixedly to one another via an adhesive layer 12 is seated with its base region 20 in a U-shaped profile 22 such that it is held in a clamped manner.

The right-hand and the left-hand limbs 24, 26 of the U-shaped profile 22 protrude upward at right angles from a web which forms the base 28 of the U-shaped profile 22, with the formation of a respective rounded portion. In the present exemplary case, said base 28 of the U-shaped profile 22 protrudes in the form of a fastening web 30 beyond the right-hand, inner limb 24. By means of the fastening web 30, the U-shaped profile 22 can be fastened to a building or to a structural connecting element. In contrast to the exemplary embodiment which is shown here, other fastening possibilities of the U-shaped profile are also possible.

The two limbs 24, 26 of the U-shaped profile 22 can be of different lengths. For instance, the inner, right-hand limb 24 can be of lower configuration than the outer, left-hand limb 26, in particular for visual reasons, in a glass-pane railing which is mounted on the end side of a floor or ceiling panel.

In the present exemplary case, the two limbs 24, 26 in each case have a kink 32, 34. Between said kinks 32, 34 and the base of the U-shaped profile 22, the wall thickness of the two limbs 24, 26 tapers in each case upward, away from the base 28 and toward the two kinks 32, 34. The wall thickness of the two limbs 24, 26 no longer tapers to such an extent above the kinks 32, 34 as below them. In contrast to the exemplary embodiment which is shown here, the wall thickness of the two limbs 24, 26 above the two kinks 32, 34 could also be of approximately constant configuration. It would also be possible to dispense with the kinks 32, 34 and to configure the two limbs 24, 26 completely with a wall thickness which tapers upward constantly or completely.

Figure 2:
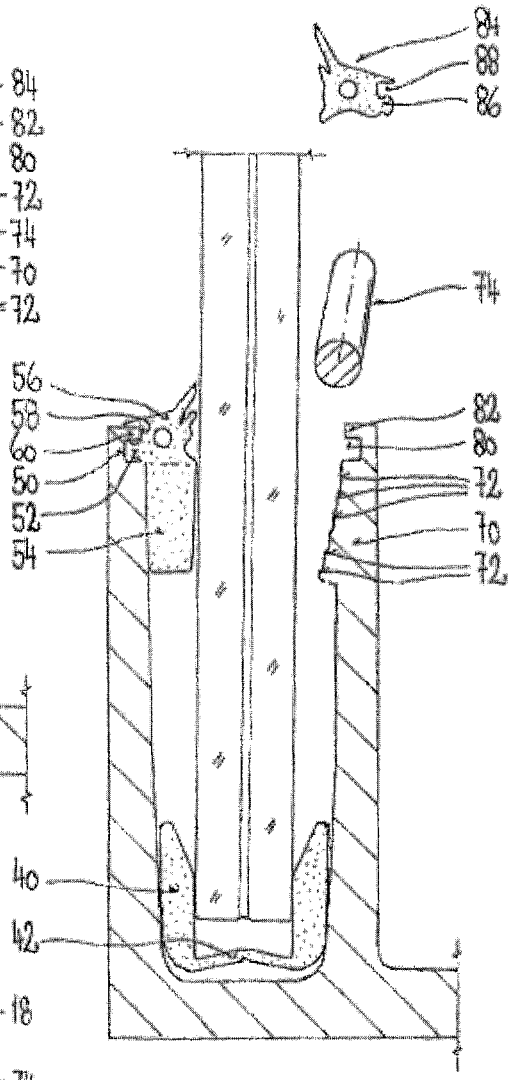
FIG. 2 shows a cross section through the base region of the glass-pane railing according to FIG. 1 during mounting.

The glass pane 18 is held with its base region 20 in the U-shaped profile 22 in a clamped manner. To this end, the glass pane 18 is enclosed in its lower edge region in a tightly bearing manner by a U-shaped profile body 40 which is of one piece in the present exemplary case. Said U-shaped profile body 40 has a base 42 with two upwardly protruding walls 44, 46. As long as no glass pane 18 has been inserted into the U-shaped profile 22 and the U-shaped profile body 40, the base 42 has the shape of a gable roof (see FIG. 2). When the base 42 with the shape of a gable roof is pressed down by an inserted glass pane 18, the lower wall regions of the two walls 44, 46 are pressed outward against the two limbs 24, 26 of the U-shaped profile 22. In this way, play-free bearing of the base region 20 of the glass pane 18 is possible in the base region of the U-shaped profile 22.

The walls 44, 46 of the U-shaped profile body 40 can be of comparatively short configuration in comparison with the two limbs 24, 26 of the U-shaped profile 22. In contrast to the exemplary embodiment which is shown here, the walls 44, 46 of the U-shaped profile body 40 could also, however, protrude as far as almost into the opening region of the U-shaped profile 22.

The U-shaped profile body 40 is composed of a lightweight plastic material which has sufficient compressive strength. The weight of the glass pane 18 becomes greater only to an insubstantial extent as a result of the U-shaped profile body 40 which is pushed onto it.

A groove 50 is provided on the inner side of the outer limb 26 in the opening region of the U-shaped profile 22. The tongue 52 of a spacer body 54 can be pushed into said groove 50, with the result that said spacer body 54 can be positioned on the outer limb 26 in a positionally secure manner at a predefined spacing from the base 28 of the U-shaped profile 22. A covering profile 56 is formed integrally on the spacer body 54. The covering profile 56 ensures a visually pleasant termination of the upper opening region of the U-shaped profile 22 and can prevent the ingress of moisture, for example as a result of rain, into the U-shaped profile 22. The covering profile 56 has a groove 58, by way of which the covering profile 56 can be fastened to a rib-like projection 60 of the outer limb 26. In contrast to the exemplary embodiment which is shown here, the spacer body 54 and covering profile 56 could also be two separate components.

In the present exemplary case, the fastening of the spacer body 54 to the outer limb 26 takes place by means of a tongue and groove connection. In contrast to this, other types of fastening would also be possible; for example, the spacer body could have a hook formation which could be hooked into a corresponding undercut in the outer limb.

In contrast to the exemplary embodiment which is shown here, the U-shaped profile body 40 and the spacer body 54 could also be connected integrally to one another. This could take place, for example, by way of a spacer projection 62 which is indicated by dash-dotted lines in FIG. 1 and connects the outer, left-hand wall 46 of the U-shaped profile body 40 to the spacer body 54. In this case, the spacer body 54 could be supported in terms of load at least partially on the U-shaped profile body 40.

A wedge-shaped shoulder projection 70 is formed integrally on the inner side of the inner limb 24 in the upper region. The wedge-shaped shoulder projection 70 has a plurality of projections 72. The individual projections 72 are arranged in each case in such a way that a lower projection protrudes further than an upper projection into the interior of the U-shaped profile 22. The surface of the wedge-shaped shoulder projection 70 is in each case of concave configuration between adjacent projections 72, with the result that a rod body 74 which, in the present exemplary case, has a circular cross section with a constant diameter can be positioned reliably between two projections 72, in order to hold the glass pane 18 in a clamped manner.

In contrast to the exemplary embodiment which is shown here, the surface of the wedge-shaped shoulder projection 70 could also be of corrugated or serrated configuration. As an alternative or in addition to this, the rod body 74 could also have a corrugated or serrated surface.

A groove 80 is present on the inner side of the inner limb above the wedge-shaped shoulder projection 70. A separate covering profile 84 can be fastened to said groove 80 and the rib-like projection 82 which is situated above it. To this end, the covering profile 84 has a tongue 86 which can be pushed into the groove 80. Moreover, the covering profile 84 has a groove 88, into which the rib-like projection 82 of the limb 24 can be pushed. In contrast to the exemplary embodiment which is shown here, other fastening possibilities of the covering profile could also be suitable. For example, the covering profile could have a hook formation which could be hooked into a corresponding undercut on the limb of the U-shaped profile.

During the mounting of the glass-pane railing 10, first of all the U-shaped profile body 40 is inserted from above into the U-shaped profile 22 and the spacer body 54 is fastened to the outer limb 26. The glass pane 18 is possibly inserted from above slightly obliquely into the U-shaped profile body 40. The rod body 74 is subsequently inserted into the opening region of the U-shaped profile 22 between the inner limb 24 and the glass pane 18. The glass pane 18 can now be pressed somewhat against the spacer body 54. Here, the rod body 74 slides or falls at least to a certain extent between the glass pane 18 and the wedge-shaped shoulder projection 70 of the inner limb 24. Should a further alignment of the glass pane 18 be desired, the rod body 74 can be pushed by means of a suitable tool more deeply into the gap which is present between the glass pane 18 and the wedge-shaped shoulder projection 70. This could also be achieved by way of increased pressure on the panel 18. In the final step, the covering profile 84 is attached in the opening region of the inner limb 24 of the U-shaped profile 22, in order to ensure a visually pleasant termination.

Figure 3:
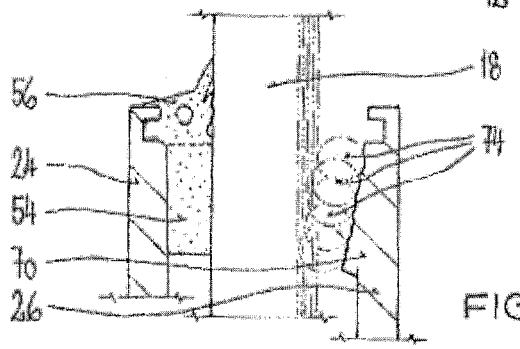
FIG. 3 shows a cross section of the opening region of the U-shaped profile with inserted panels (indicated by dash-dotted lines) of different thickness.

As can be gathered, in particular, from FIG. 3, the installation of various glass panes 18 with different thicknesses can take place in identical U-shaped profiles 22 by way of the use of rod bodies 74 with a uniform diameter. Irrespectively of the desired glass thickness of the glass pane to be installed, no different U-shaped profiles therefore have to be kept in store. Merely U-shaped profile bodies of different thickness and possibly spacer bodies 54 of different thickness, if the glass pane is to be present in the center of the U-shaped profile, have to be kept in store. As a result, the required warehouse costs are reduced considerably.

In contrast to the exemplary embodiments which are shown in the drawing, the rod body could be shrunk in its longitudinal axis to produce a body, in which the longitudinal extent is not greater than the transverse extent. As a result, for example, a round rod could also assume the shape of a ball.

The invention claimed is:

1. A panel railing comprising:

a dimensionally stable U-shaped profile having two limbs;

a glass pane;

a U-shaped profile body; and a spacer body and a rod body that are provided in an opening region of the U-shaped profile, wherein:

between the two limbs, a base region of the glass pane is held in a clamped manner, each of the spacer body and the rod body is disposed between the glass pane and a respective one of the two limbs, the rod body is provided in an upper, free edge region of one of the two limbs, said rod body being placed in a pressing manner with one outer face against the limb and with its other outer face opposite the former against the panel, an inner side of the one limb is placed against an inner side of the rod body in a pressing manner, said inner side of the limb having at least one projection which protrudes from the limb in the direction of the glass pane and is present below a maximum width extent of the rod body, the rod body is a round rod which rests on the projection of the limb in a state in which it is seated to the maximum extent in the U-shaped profile, the glass pane is enclosed in its lower edge region in a tightly bearing manner by the U-shaped profile body such that a play-free bearing is provided to the base region of the glass pane, lower wall regions of the U-shaped profile body are pressed outward against the two limbs, the inner side of the limb, against which inner side of the rod body can be placed in a pressing manner, has a plurality of projections which are arranged at a mutual spacing from one another, and said inner side of the limb is configured to have a wedge shape such that a respectively lower projection protrudes further than an upper projection into the interior of the U-shaped profile in the direction transversely with respect to the panel plane.

2. The panel railing according to claim 1, wherein the rod body has identical maximum width cross sections along its rod axis.

3. The panel railing according to claim 2, wherein the rod body has identical cross sections along its rod axis.

4. The panel railing according to claim 1, wherein there are different rod bodies with maximum width cross sections which are different from one another.

5. The panel railing according to claim 1, wherein the glass pane is held on its one side by the rod body and on its other side by the spacer body such that it can be pressed in between the two limbs.

6. The panel railing according to claim 5, wherein the spacer body is present such that it can be clipped in a groove of the respective limb.

7. The panel railing according to claim 1, wherein there is a covering profile which covers the upper opening region of the U-shaped profile on each side laterally.

8. The panel railing according to claim 7, wherein the covering profile is connected integrally to the spacer body.

9. The panel railing according to claim 7, wherein the covering profile has a longitudinal groove, and at least one limb has a rib-shaped projection which is inserted in a clamping manner into the longitudinal groove of the covering profile.

* * * * *